US010315809B2

(12) United States Patent
Shinozaki et al.

(10) Patent No.: US 10,315,809 B2
(45) Date of Patent: Jun. 11, 2019

(54) FORMED LID, METHOD FOR FITTING THE LID TO CONTAINER, AND SEALING METHOD

(71) Applicant: Toyo Seikan Co., Ltd., Tokyo (JP)

(72) Inventors: Kiyotaka Shinozaki, Tokyo (JP); Makoto Sawada, Yokohama (JP); Yoshiaki Shinagawa, Yokohama (JP)

(73) Assignee: Toyo Seikan Co., Ltd., Tokyo (JP)

( * ) Notice: Subject to any disclaimer, the term of this patent is extended or adjusted under 35 U.S.C. 154(b) by 356 days.

(21) Appl. No.: 15/101,453

(22) PCT Filed: Dec. 16, 2014

(86) PCT No.: PCT/JP2014/083202

§ 371 (c)(1),
(2) Date: Jun. 3, 2016

(87) PCT Pub. No.: WO2015/093458

PCT Pub. Date: Jun. 25, 2015

(65) Prior Publication Data

US 2016/0304252 A1 Oct. 20, 2016

(30) Foreign Application Priority Data

Dec. 18, 2013 (JP) ..... 2013-260770

(51) Int. Cl.
*B65B 7/28* (2006.01)
*B65B 51/22* (2006.01)
(Continued)

(52) U.S. Cl.
CPC ..... *B65D 43/065* (2013.01); *B65B 7/28* (2013.01); *B65B 7/2878* (2013.01); *B65B 51/22* (2013.01);
(Continued)

(58) Field of Classification Search
CPC ..... B65D 43/0202; B65D 43/0204; B65D 43/021; B65D 43/0214; B65D 43/022;
(Continued)

(56) References Cited

U.S. PATENT DOCUMENTS 3,773,207 A * 11/1973 Dokoupil et al. . B65D 43/0254 220/266
4,877,151 A * 10/1989 Rush et al. ..... B65D 43/0212 206/514
(Continued)

FOREIGN PATENT DOCUMENTS

CH 607701 A5 * 10/1978 ..... B65D 43/022
DE 3816021 A1 * 3/1989 ..... B65D 43/022
(Continued)

OTHER PUBLICATIONS

International Search Report of PCT/JP2014/083202, dated Mar. 17, 2015. [PCT/ISA/210].
Communication dated Jun. 26, 2017, from the European Patent Office in counterpart European Application No. 14871636.8.

*Primary Examiner* — Stephen F. Gerrity
(74) *Attorney, Agent, or Firm* — Sughrue Mion, PLLC

(57) ABSTRACT

A drop lid-shaped formed lid to be fittably applied to a container having a flange section is formed with a flange, a fitting section extending downwardly from the flange, and an introducing section below the fitting section. The introducing section is composed of first and second tapered sections whose inner diameters each decrease downwardly. The taper angle β of the second tapered section is larger than the taper angle α of the first tapered section, and the second tapered section is formed in an arcuate shape smaller than a range in which the first tapered section is formed.

9 Claims, 4 Drawing Sheets

(51) Int. Cl.

| | |
|---|---|
| ***B65D 43/02*** | (2006.01) |
| ***B65D 43/06*** | (2006.01) |
| ***B65D 43/08*** | (2006.01) |
| ***B65D 77/20*** | (2006.01) |

(52) U.S. Cl.

CPC ..... *B65D 43/022* (2013.01); *B65D 43/08* (2013.01); *B65D 77/20* (2013.01); *B65D 77/2024* (2013.01); *B65D 2543/00027* (2013.01); *B65D 2543/00092* (2013.01); *B65D 2543/00296* (2013.01); *B65D 2543/00425* (2013.01); *B65D 2543/00509* (2013.01); *B65D 2543/00648* (2013.01); *B65D 2543/00657* (2013.01); *B65D 2543/00685* (2013.01); *B65D 2543/00759* (2013.01); *B65D 2543/00768* (2013.01); *B65D 2543/00796* (2013.01); *B65D 2543/00842* (2013.01)

(58) Field of Classification Search

CPC ..... B65D 43/06; B65D 43/065; B65D 43/08; B65D 77/2024; B65D 2543/0049; B65D 2543/00518; B65D 2543/00546; B65D 2543/00768

See application file for complete search history.

(56) References Cited

U.S. PATENT DOCUMENTS

| | | | | |
|---|---|---|---|---|
| 2006/0278652 | A1* | 12/2006 | Vovan et al. ..... | B65D 43/0254 220/793 |
| 2009/0084796 | A1* | 4/2009 | Coonce et al. .... | B65D 43/0208 220/508 |
| 2011/0253717 | A1* | 10/2011 | Luburic et al. ..... | B65D 43/026 220/266 |

FOREIGN PATENT DOCUMENTS

| | | | | | |
|---|---|---|---|---|---|
| EP | 0251418 | A1 | * | 1/1988 | ..... B65D 43/021 |
| EP | 0253456 | A1 | * | 1/1988 | ..... B65D 43/0206 |
| FR | 2418751 | A1 | * | 9/1979 | ..... B65D 43/021 |
| JP | 58-46760 | U1 | | 3/1983 | |
| JP | 2000-128166 | A | | 5/2000 | |
| JP | 2000-203608 | A | | 7/2000 | |
| JP | 2002-193292 | A | | 7/2002 | |
| JP | 2003-237721 | A | | 8/2003 | |
| JP | 2006052012 | A | * | 2/2006 | ..... B65D 43/0254 |
| JP | 2007-126174 | A | | 5/2007 | |
| JP | 2010-52787 | A | | 3/2010 | |
| JP | 2013001432 | A | * | 1/2013 | ..... B29C 65/1616 |
| WO | 2006/091471 | A2 | | 8/2006 | |

* cited by examiner

Fig. 1
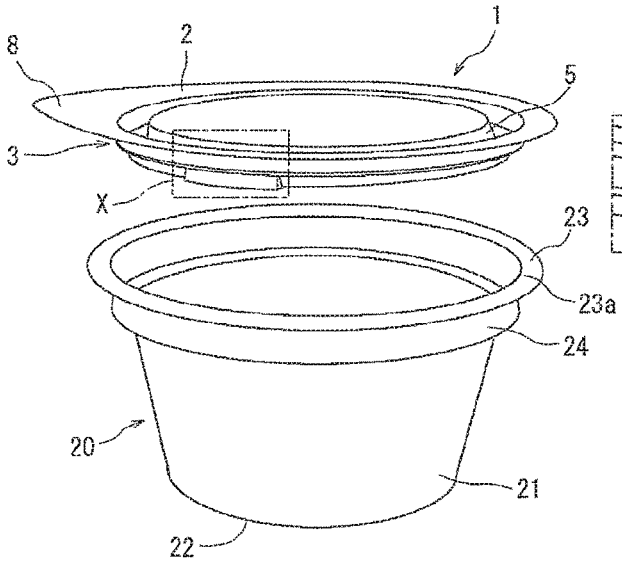
(A)
Fig. 1A
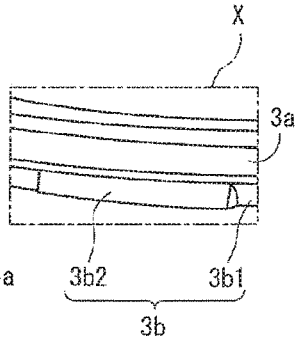
(B)
Fig. 1B
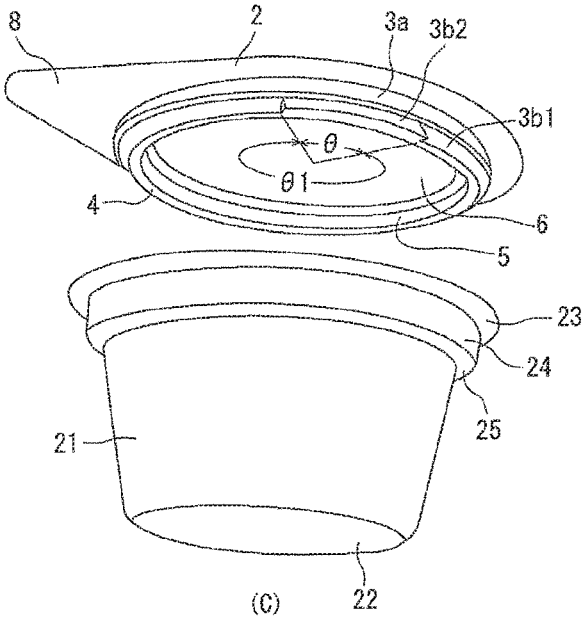
(C)
Fig. 1C

FORMED LID, METHOD FOR FITTING THE LID TO CONTAINER, AND SEALING METHOD

CROSS REFERENCE TO RELATED APPLICATIONS

This application is a National Stage of International Application No. PCT/JP2014/083202 filed Dec. 16, 2014, claiming priority based on Japanese Patent Application No. 2013-260770, filed Dec. 18, 2013, the contents of all of which are incorporated herein by reference in their entirety.

TECHNICAL FIELD

This invention relates to a formed lid which can be fitted to a container having a flange section, and a method for fitting them. More specifically, the invention relates to a formed lid which can be reliably supplied and fitted to the container even under high speed conditions, has good productivity and is capable of sealing.

BACKGROUND ART

As a formed lid which can be fitted to a cup-shaped container having a flange section, a drop lid-shaped one is known which generally comprises a side wall suspending downwardly from the inner edge of a flange section, and a top panel formed at the lower end of the side wall.

For such a combination of the formed lid and the cup-shaped container, it is common practice to subject the container, which is transported by a conveyor or the like, to a process including a step of filling contents into the container, a step of supplying the formed lid to the container, a step of fitting the formed lid and the container together, and a sealing step, thereby sealing the container, while stopping the container in each step in order to perform the operations intermittently.

For the sealing of the formed lid and the cup-shaped container in the above-mentioned sealing step, welding by heat sealing is generally widely used, because it is a convenient measure. Welding by heat sealing, however, takes time for heat fusion and subsequent cooling, and is not fully satisfactory in terms of productivity. A general heat sealing method using a heat sealing bar, moreover, requires that heat be conducted from the outer surface of a welding region to a surface to be sealed. In a thick-walled container or the like, heat conduction takes time, and productivity decreases. Thus, there are limitations on the wall thickness, and the problem arises that the degrees of freedom of the container and lid shapes are low. Furthermore, a predetermined time is taken until the heat sealing area is cooled and completely closed. In the case of filling contents having a self-generated pressure or hot filling, in particular, a gas in a head space thermally expanded by sealing heat escapes from the sealing region in a molten state, thereby posing the possibility of seal peeling.

As a method of welding packaging members, such as a container and a lid, on the other hand, welding by laser has also been known so far. Patent Document 1, for example, proposes that a bottom cover and an upper lid be welded to a container body by laser welding for integration. In such welding of packaging members by laser welding, the seal interface is welded without great restrictions on the wall thicknesses of the members, and the time required for welding is shortened in comparison with heat sealing. Thus, the productivity is improved compared with the heat sealing method. Besides, laser welding enables continuous welding operations. Thus, laser welding can be performed without the need to stop the container once in the sealing step (laser welding step), so that a further increase in productivity can be achieved.

PRIOR ART DOCUMENTS

Patent Documents

Patent Document 1: JP-A-2000-128166

SUMMARY OF THE INVENTION

Problems to be Solved by the Invention

No matter which sealing means is used, however, if the container lid is supplied, with the container moving without stopping, in the preceding step, the formed lid supply step, the formed lid may be inaccurately placed on the container. In the subsequent fitting step, the formed lid may fail to be fitted reliably. Thus, the transport of the container needs to be stopped once during the formed lid supply step. This step acts as a rate-determining step, eventually making a production speed increase impossible.

It is an object of the present invention, therefore, to provide a formed lid excellent in the properties of being suppliable and fittable to a container being transported.

Another object of the present invention is to provide a fitting method capable of fitting a formed lid and a container together with good productivity, and a sealing method.

Means for Solving the Problems

According to the present invention, there is provided a drop lid-shaped formed lid to be fittably applied to a container having a flange section, wherein the formed lid is formed with a flange, a fitting section extending downwardly from the flange, an introducing section below the fitting section, the introducing section is composed of first and second tapered sections whose inner diameters each decrease downwardly, the taper angle $\beta$ of the second tapered section is larger than the taper angle $\alpha$ of the first tapered section, and the second tapered section is formed in an arcuate shape smaller than a range in which the first tapered section is formed.

In the formed lid of the present invention, the following features are preferred:

1. The taper angle $\alpha$ of the first tapered section is 30 to 75 degrees with respect to the horizontal direction, and the taper angle $\beta$ of the second tapered section is $\alpha+10$ to $\alpha+60$ degrees, but is equal to or smaller than 90 degrees, with respect to the horizontal direction. That is, $\beta=\alpha+10$ to $\alpha+60$ and $\beta\leq 90$.

2. The second tapered section is formed in the range of 15 to 60 degrees with respect to the entire periphery of the introducing section.

3. The fitting section is formed in a tapered shape whose inner diameter increases downwardly.

4. A horizontal stepped section is formed between the fitting section and the introducing section.

5. The drop lid-shaped formed lid is composed of a flange section, an outer side wall section suspending from the inner peripheral edge of the flange section, an annular section extending horizontally and inwardly from the lower end of the outer side wall section, an inner side wall section extending upwardly from the inner peripheral edge of the annular section, and a top panel located horizontally and inwardly starting from the upper end of the inner side wall section, and the fitting section and the introducing section are formed in the outer side wall section.

6. A stepped section extending horizontally and inwardly is formed in the inner side wall section.

7. A lower inner side wall section below the stepped section in the inner side wall section is formed in a tapered shape whose inner diameter decreases downwardly.

According to the present invention, there is also provided a method for fitting a formed lid to a container, which includes supplying the above formed lid from above to a container being transported to fit the formed lid to the container, the method comprising falling the formed lid obliquely with respect to the transport direction of the container to supply the formed lid onto the container so that a part of the second tapered section of the formed lid initially contacts the inner peripheral end of a flange section of the container rearward in the transport direction of the container; moving the formed lid to the middle of the container, while accommodating the formed lid in the middle of the container, by the first tapered section of the formed lid; and then pressing the formed lid from above to fit the formed lid to the container.

According to the present invention, there is further provided a method for sealing a container, which comprises welding the flange sections by laser welding after fitting the above formed lid to the container.

Effects of the Invention

The formed lid of the present invention is a lid preferably for use in a lid fitting device which automatically supplies a formed lid from above to a container being transported, and presses the formed lid from above to fit it to the container. The introducing section formed with the two tapers different in the taper angle is formed below the fitting section of the formed lid. Even when the formed lid is supplied from above to the container moving for transport in the filling and sealing steps, therefore, the formed lid can be accurately supplied to the container and reliably fitted to the container. That is, the second tapered section with a large taper angle in the formed lid supplied from above is easily engageable with the inner peripheral end (opening end) of the flange section of the container rearward with respect to the travel direction of the container. Thus, the formed lid can be prevented from falling off the container. Moreover, the first tapered section with a small taper angle facilitates the introduction of the formed lid into the container along the opening end of the container. Thus, the formed lid can be easily centered with respect to the container.

Furthermore, the stepped section is formed in the inner side wall section of the formed lid, and the taper is further formed in the lower inner side wall section. Even if a plurality of the formed lids are stacked, therefore, the formed lid located above can be effectively inhibited from tightly engaging the formed lid located below. Consequently, the formed lid can be supplied from the stacked state of the formed lids, and excels in stackability.

With the method for fitting the formed lid to a container according to the present invention, the second tapered section of the formed lid is brought into contact with the part of the container rearward in the travel direction of the container. As a result, the formed lid can be allowed to follow the transportational movement of the container. Consequently, the formed lid does not slip down from the container, and the formed lid can be reliably supplied to the container. Moreover, the formed lid can be centered in alignment with the opening of the container by the action of the first tapered section of the formed lid. Hence, even when the container lid is transported at a high speed, the formed lid can be reliably fitted to the container.

Besides, sealing is performed by laser welding, whereby sealing of the container can be carried out continuously. This effect, coupled with the use of the above-described formed lid, can lead to a further increase in high speed productivity.

BRIEF DESCRIPTION OF THE DRAWINGS

FIGS. 1A to 1C are perspective views of an example of a formed lid according to the present invention and an example of a container, FIG. 1A showing the perspective view as seen from an obliquely upper side, FIG. 1B showing an enlarged view of an X section in FIG. 1A, and FIG. 1C showing the perspective view as seen from an obliquely lower side.

Figure 2A:
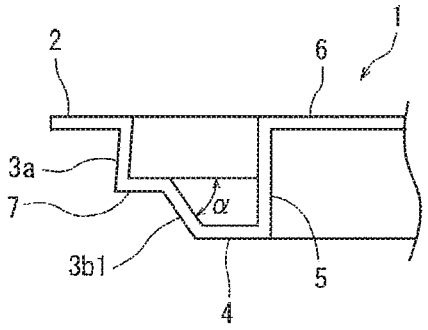
FIGS. 2A and 2B are schematic views, partly in section, of the formed lid shown in FIGS. 1A to 1C, 2A showing the sectional view at the position of a first tapered section, and FIG. 2B showing the sectional view at the position of a second tapered section.
Figure 2B:
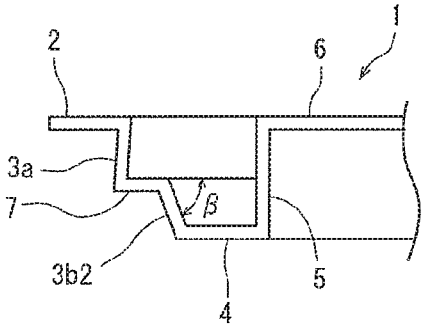

MODE FOR CARRYING OUT THE INVENTION (Formed Lid)

A formed lid according to the present invention will be described using the accompanying drawings.

By reference to FIGS. 1A to 1C and FIGS. 2A, 2B, a formed lid 1 of the present invention is roughly composed of a flange section 2, an outer side wall section 3 suspending from the inner peripheral edge of the flange section 2, an annular section 4 extending horizontally and inwardly from the lower end of the outer side wall section 3, an inner side wall section 5 extending upwardly from the inner peripheral edge of the annular section 4, and a top panel 6 located horizontally and inwardly starting from the upper end of the inner side wall section 5. Partly in the flange section 2, a grip section 8 wider than other parts of the flange section 2 is formed. By holding the grip section 8 and pulling it upward, the formed lid 1 can be opened.

In the above-mentioned basic configuration of the formed lid according to the present invention, it is important for the outer side wall section 3 to have, in an upper part thereof, a fitting section 3*a* making intimate contact with the inner surface of a container to be described later; and to have, below the fitting section 3*a*, an introducing section 3*b* composed of a first tapered section 3*b*1 for centering the formed lid 1 with respect to the container and smoothly introducing the formed lid 1 into the container during fitting, and a second tapered section 3*b*2 for preventing the formed lid, which has been supplied from above, from slipping down from the container being transported. A stepped section 7 extending horizontally and inwardly is formed between the fitting section 3*a* and the introducing section 3*b*, and the centers of the formed lid 1 and the container 20 after centering are brought into satisfactory alignment.

In the concrete example shown in FIGS. 1A to 1C and FIGS. 2A, 2B, the introducing section 3*b* is formed with the first tapered section 3*b*1 and the second tapered section 3*b*2 arranged side by side in the circumferential direction, with the first and second tapered sections 3*b*1 and 3*b*2 having different taper angles and decreasing downwardly in the diameter of the outer side wall section 3. As clear from FIG. 1C, the arcuate second tapered section 3*b*2 having an angle θ with respect to the entire periphery of the introducing section 3*b* is formed, while the arcuate first tapered section 3*b*1 is formed in the remaining range with the angle (360−θ=θ1). Desirably, the angle θ is smaller than the central angle of the first tapered section, and is preferably in the range of 15 to 60 degrees, particularly, 30 to 45 degrees, in order to facilitate engagement with the container, and not to impede centering with respect to the container.

Also, the first tapered section 3*b*1 functions to introduce the formed lid smoothly into the container during capping, and desirably has a taper angle α of 30 to 75 degrees, particularly 45 to 60 degrees, for smooth entry of the formed lid 1 into the container 20, thus resulting in short-term centering. On the other hand, the second tapered section 3*b*2 desirably has a taper angle β, which is α+10 to α+60 degrees and which is equal to or smaller than 90 degrees, particularly in the range of 60 to 90 degrees, so that when the formed lid is fallen from above and supplied to the container during capping, the second tapered section 3*b*2 is locked to the opening end of the container. By so doing, high speed production can be achieved.

Furthermore, the fitting section 3*a* has an outwardly broadening taper formed to increase the inner diameter of the fitting section 3*a* in a downward direction. This feature can prevent the formed lid 1 from entering the container 20, with the formed lid 1 being in an inclined state or with the centers of the formed lid 1 and the container 20 being out of alignment, or can prevent the fall of the formed lid 1 from the container 20 during transport.

The container 20 shown in FIGS. 1A to 1C, to which the formed lid of the present invention is applied, is composed schematically of a trunk 21, a bottom 22, and a flange 23 extending horizontally from the opening end of the container 20. Above the trunk 21, a fitting section 24 to make intimate contact with the aforementioned fitting section 3*a* of the formed lid 1 is formed, and a step 25 serving as a stack section is formed at the lower end of the fitting section 24. In the concrete example shown in FIGS. 1A to 1C, the fitting section 24 of the container 20 shows a taper broadening downwardly outwardly.

The fitting section 3*a* of the formed lid 1 and the fitting section 24 of the container 20 may have the same taper angle, as long as they are attached by pressure. If no taper is formed, various forms can be adopted, for example, a form in which the inner diameter of the fitting section 3*a* of the formed lid 1 is greater than the inner diameter of the fitting section 24 of the container 20.

Figure 3:
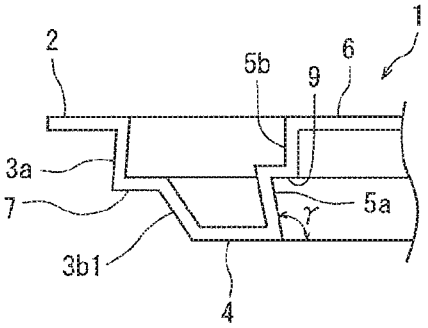
FIG. 3 is a schematic view, partly in section, of another example of the formed lid of the present invention.

In the formed lid of the present invention, as shown in FIG. 3, it is desirable that a stepped section 9 extending horizontally be formed in the inner side wall section 5. By so doing, when a plurality of the formed lids of the present invention having the same shape are stacked, the formed lid located above can be prevented from being completely fitted to the formed lid located below. Even when the plurality of formed lids are stacked, they can be easily detached one by one, so that the stacking function of the formed lid is improved.

In the present embodiment, moreover, an upper inner side wall section 5*b* above the stepped section 9 in the inner side wall section 5 particularly preferably extends nearly vertically from the stepped section 9, whereas a lower inner side wall section 5*a* below the stepped section 9 in the inner side wall section 5 is particularly preferably formed in a tapered shape decreasing downwardly in inner diameter.

Figure 5:
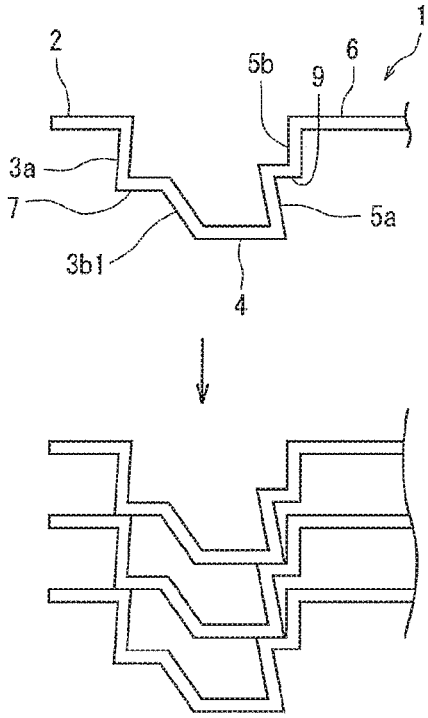
FIG. 5 is a view for illustrating a state in which a plurality of the formed lids of the present invention, as the one example, are stacked.

In this configuration, when a plurality of the formed lids are stacked as shown in FIG. 5, the inner side wall section 5*a* defines an undercut, thereby making it difficult for the upper formed lid to be fitted to the lower formed lid, so that the above-mentioned actions and effects can be exhibited more reliably.

The stepped section 9 of the inner side wall section 5 desirably has a width of 2 mm or more from the viewpoint of holding the formed lid located above, namely, the viewpoint of stackability, although the value of the width depends on the diameter of the formed lid. The taper angle γ of the inner side wall section 5*a* below the stepped section 9 is desirably in excess of 90 degrees, but within 100 degrees.

As long as the formed lid of the present invention is a formed lid including the flange section, the fitting section, and the introducing section composed of the first tapered section and the second tapered section, as mentioned above, its shape is not limited. In the concrete example illustrated in the drawings, the side wall is in a double wall configuration composed of the outer side wall section and the inner side wall section. However, the formed lid may, needless to say, be one in which the top panel is formed directly from the lower end of the outer side wall section. Nor is the method for forming the formed lid limited, but the formed lid is particularly preferably one formed by thermoforming, such as vacuum forming, pressure forming, or plug-assist forming, with the use of a sheet-shaped single layer or multilayer material.

For a container to which the formed lid of the present invention is applied, no limitations are imposed on the shape of the container or the method of forming the container, as long as the resulting container is provided with a flange section as a site of welding. However, the container can be exemplified by a container such as a cup or tray formed by thermoforming, such as vacuum forming, pressure forming, or plug-assist forming, using a sheet-shaped monolayer or multilayer material, or a bottomed cup formed by draw forming.

The materials for the formed lid and the container will be described later, because preferred materials for them are different depending on the sealing method.

(Supply and Fitting Method)

The supply of the formed lid of the present invention to the container, and the method of fitting the formed lid and the container will be described using FIGS. 4A to 4E.

Figure 4A:
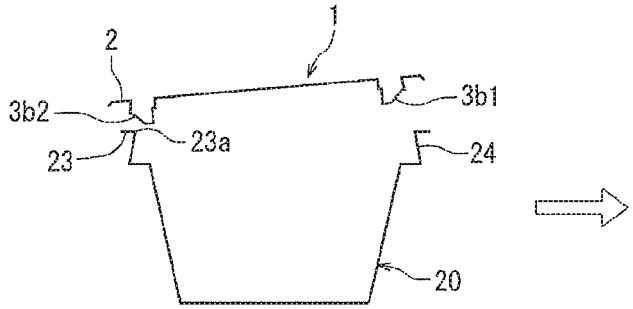
FIGS. 4A to 4E are views for illustrating a fitting method according to the present invention.
Figure 4B:
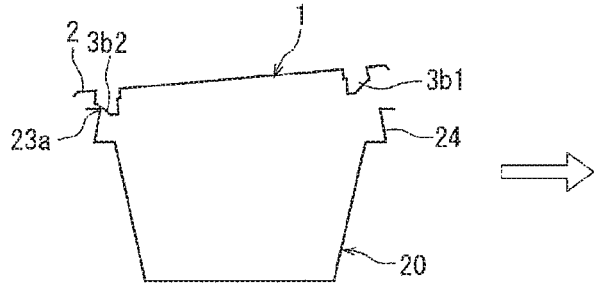

As shown in FIG. 4A, the container 20 is transported in the direction of an arrow, and the formed lid 1 is fallen from above so that the second tapered section 3*b*2 of the formed lid 1 contacts, from above the container 20, the inner peripheral end (container opening end) 23*a* of the flange 23 at a site rearward in the travel direction of the container 20. On this occasion, the formed lid 1 is desirably fallen obliquely, with the second tapered section 3*b*2 being located at a lower position, so that the second tapered section 3*b*2 contacts the container first of all. As a result, the second tapered section 3*b*2 is locked to the container opening end 23*a*. Thus, the formed lid 1 follows the movement of the container being transported, without dropping from the container 20 (FIG. 4B).

Figure 4C:
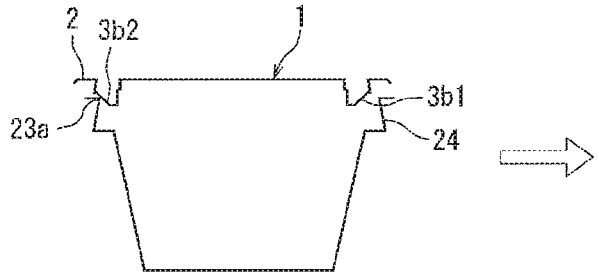

Immediately after the formed lid 1 dropped obliquely is placed nearly horizontally on the container 20, the formed lid 1 is located upstream in the travel direction of the container 20 and, in this state, the centers of the formed lid 1 and the container 20 are out of alignment, as shown in FIG. 4C. However, the fitting section 3*a* of the formed lid 1 is formed in an outwardly broadening tapered shape, thus preventing a part of the formed lid 1 from entering the inside of the container 20 and lying there in an inclined posture.

Figure 4D:
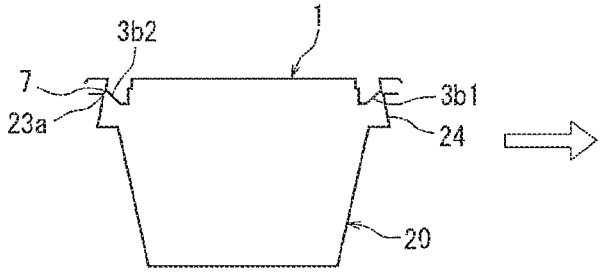
Figure 4E:
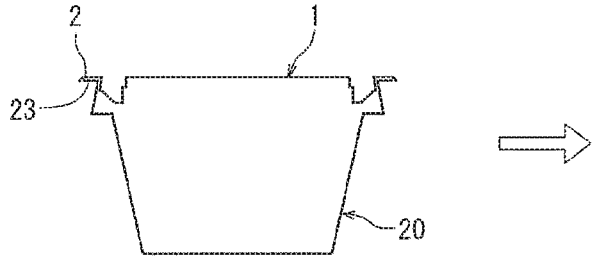

Then, the introducing section 3*b* and the stepped section 7 of the formed lid 1 make contact with nearly the entire periphery of the container opening end 23*a*, and the formed lid 1 is centered with respect to the container 20, whereupon the centers of the formed lid 1 and the container 20 are aligned (FIG. 4D). In this state, the formed lid 1 is pressed from above, whereby the fitting section 3*a* of the formed lid 1 and the fitting section 24 of the container 20 are press attached. As a result, the formed lid 1 and the container 20 are fitted together, and the flange section 2 of the formed lid 1 and the flange 23 of the container 20 are also brought into contact (FIG. 4E). In a subsequent sealing step, the flange 23 is welded to seal the container 20.

(Sealing Method)

In the foregoing fitting step, the container 20 is firmly fitted with the formed lid 1, as shown in FIG. 4E and then the flange 23 of the container 20 is welded to seal the container 20.

The welding of the formed lid of the present invention to the container can be performed by a conventionally known method such as heat sealing or ultrasonic welding. In the present invention, however, welding by laser welding, in particular, is preferred, because continuous irradiation is possible, enabling high speed sealing, as described above.

After fitting of the formed lid, the container or a laser oscillator is moved (rotated) in conformity with the shapes of the flange sections of the container and the formed lid, whereby laser light is scanned over the flange sections of the container and the lid for welding. On this occasion, the flange sections of the container and the formed lid are irradiated with laser beams from the side of the member composed of a laser transmitting thermoplastic resin to generate heat from a laser absorbing thermoplastic resin composition. Consequently, the laser transmitting thermoplastic resin is melted to melt and closely attach the contact surfaces of the container and the formed lid.

The formed lid of the present invention is firmly fitted to the container because of the presence of the fitting section of the formed lid and, during irradiation with laser beams, the flange sections, which are the contact surfaces of the formed lid and the container, are also in close contact. In order to weld them more efficiently, however, it is particularly desirable to bring them into more intimate contact with the use of a jig or the like for pressing and fixing the flange section of the formed lid.

In the present invention, one of the formed lid and the container is composed of a laser transmitting thermoplastic resin, while the other of them is composed of a laser absorbing thermoplastic resin composition. Either of them may be a laser absorbing thermoplastic resin composition, but it is particularly preferred that the formed lid be composed of a laser absorbing thermoplastic resin composition, because this enables the transparency of the container to be retained. In this case, the flange sections are pressed and fixed from the formed lid side, and laser irradiation is performed from obliquely below the container, whereby the flange sections of the formed lid and the container can be welded for sealing.

Only the flange section of the formed lid or the container, which is the site of welding, may be formed from a laser absorbing thermoplastic resin composition, while the trunk and bottom of the container may comprise a laser transmitting thermoplastic resin containing no exothermic member, or may have a multilayer structure. Alternatively, only the flange section of the formed lid may be composed of a laser absorbing thermoplastic resin composition, while the middle of the formed lid may comprise a laser transmitting thermoplastic resin.

As the thickness of the flange section, the site of welding, in the formed lid and the container, the portion composed of the laser transmitting thermoplastic resin is desirably in a thickness of 0.1 to 2.0 mm, particularly 0.5 to 1.2 mm. If the thickness of the portion composed of the laser transmitting thermoplastic resin is smaller than this range, reliable welding cannot be performed. If the thickness is greater than the above range, it will become difficult to let the laser beam arrive at the portion composed of the laser absorbing thermoplastic resin composition under ordinary conditions, making reliable welding unachievable.

The portion composed of the laser absorbing thermoplastic resin composition, on the other hand, is desirably in the thickness range of 0.1 to 2.0 mm, particularly 0.5 to 1.2 mm. If the thickness of the portion composed of the laser absorbing thermoplastic resin composition is smaller than the above range, reliable welding is impossible to perform. If the thickness is greater than the above range, economic efficiency will be inferior.

The laser transmitting thermoplastic resin for use in the formed lid of the present invention or the container is preferably a thermoplastic resin having a laser transmittance of 70% or more, particularly 80% or more, in order to increase productivity. The laser transmittance can be found by measuring the transmittance of light, which corresponds to the wavelength of laser light for use, with the use of a spectrophotometer.

The laser transmittance depends on the thickness even in the same thermoplastic resin. In the present invention, the thermoplastic resin is meant to have a transmittance of 70% or more within the range of the thickness to be described later.

Examples of such a thermoplastic resin are preferably styrene resins such as impact resistant polystyrene; olefin resins such as low, medium, and high density polyethylenes, isotactic polypropylene, propylene-ethylene copolymer, polybutene-1, ethylene-propylene copolymer, ethylene-butene-1 copolymer, propylene-butene-1 copolymer, and ethylene-propylene-butene-1 copolymer; and polyester resins such as polyethylene terephthalate. That is, those hitherto used in packaging containers are desirable. In particular, they need to be easily melted by the heat generation of the laser absorbing resin composition. Thus, the use of thermoplastic resins having a melting point of 250° C. or lower is preferred, because they can be easily welded. Polyethylene and polypropylene, in particular, can be used preferably.

In the laser absorbing resin composition, the use of the same thermoplastic resin as the thermoplastic resin used as the above-mentioned laser transmitting thermoplastic resin is preferred from the aspect of laser weldability.

As the laser absorbing resin composition of the present invention, one uniformly containing an exothermic substance in a resin composition is desirable from the viewpoint of easily melting the laser transmitting thermoplastic resin at the sealing interface. Examples of such an exothermic substance are oxygen absorbers such as an iron powder and coloring pigments such as carbon black.

The exothermic substance is desirably incorporated in an amount of generally 0.01 to 0.30 part by weight, particularly 0.05 to 0.15 part by weight, per 100 parts by weight of the thermoplastic resin, although the amount depends on the type of the exothermic substance used.

The laser usable in the sealing method of the present invention is the laser so far used in laser welding. A gas laser, a solid laser, or a semiconductor laser, for example, can be used and, of them, the semiconductor laser can be used preferably from the aspects of downsizing of equipment and cost.

The output of the laser oscillator is preferably in the range of 100 to 500 W, particularly 200 to 350 W. The laser used is commercially determined by the perviousness of the resin, the nature of the substance absorbing laser beams and generating heat, and the output, price and safety of the laser oscillator.

INDUSTRIAL APPLICABILITY

The formed lid of the present invention can be stably supplied and fitted to a container, which is transported at a high speed, and can be used preferably for a container to be sealed by laser welding and produced at a high speed, in particular.

EXPLANATION OF LETTERS OR NUMERALS

1 formed lid, 2 flange section, 3 outer side wall section, 3*a* fitting section, 3*b* introducing section, 3*b*1 first tapered section, 3*b*2 second tapered section, 4 annular section, 5 inner side wall section, 5*a* lower inner side wall section, 5*b* upper inner side wall section, 6 top panel, 7 stepped section, 9 stepped section, 20 container, 23 flange.

The invention claimed is:

1. A drop lid-shaped formed lid to be fittably applied to a container having a flange, wherein the formed lid is formed with a flange section, a fitting section extending downwardly from the flange section, and an introducing section below the fitting section, the introducing section is composed of first and second tapered sections whose inner diameters each decrease downwardly, a taper angle β of the second tapered section with respect to a horizontal direction is larger than a taper angle α of the first tapered section with respect to the horizontal direction, the second tapered section is formed in an arcuate shape smaller than a range in which the first tapered section is formed, and a horizontal stepped section is formed between the fitting section and the introducing section.

2. The formed lid according to claim 1, wherein the taper angle α of the first tapered section is 30 to 75 degrees with respect to a horizontal direction, and the taper angle β of the second tapered section is α+10 to α+60 degrees, but is equal to or smaller than 90 degrees, with respect to the horizontal direction.

3. The formed lid according to claim 1, wherein the second tapered section is formed in a range of 15 to 60 degrees with respect to an entire periphery of the introducing section.

4. The formed lid according to claim 1, wherein the fitting section is formed in a tapered shape whose inner diameter increases downwardly.

5. The formed lid according to claim 1, wherein the drop lid-shaped formed lid is composed of a flange section, an outer side wall section suspending from an inner peripheral edge of the flange section, an annular section extending horizontally and inwardly from a lower end of the outer side wall section, an inner side wall section extending upwardly from an inner peripheral edge of the annular section, and a top panel located horizontally and inwardly starting from an upper end of the inner side wall section, and the fitting section and the introducing section are formed in the outer side wall section.

6. The formed lid according to claim 5, wherein a stepped section extending horizontally is formed in the inner side wall section.

7. The formed lid according to claim 6, wherein a lower inner side wall section below the stepped section in the inner side wall section is formed in a tapered shape whose inner diameter decreases downwardly.

8. A method for fitting a formed lid to a container, which includes supplying the formed lid according to claim 1 from above to a container being transported to fit the formed lid to the container, comprising:

dropping the formed lid obliquely with respect to a transport direction of the container to supply the formed lid onto the container so that a part of the second tapered section of the formed lid initially contacts an inner peripheral end of a flange of the container rearward in the transport direction of the container;

moving the formed lid to a middle of the container, while accommodating the formed lid in the middle of the container, by the first tapered section of the formed lid; and then pressing the formed lid from above to fit the formed lid to the container.

9. A method for fitting a formed lid to a container according to claim 8, comprising a further step of laser welding flange sections of the container and the formed lid after said pressing step.

* * * * *